US012383019B1

(12) United States Patent
Hua

(10) Patent No.: US 12,383,019 B1
(45) Date of Patent: Aug. 12, 2025

(54) FIGURE SKATE

(71) Applicant: Weimin Hua, Jiangsu (CN)

(72) Inventor: Weimin Hua, Jiangsu (CN)

( * ) Notice: Subject to any disclaimer, the term of this patent is extended or adjusted under 35 U.S.C. 154(b) by 0 days.

(21) Appl. No.: 19/016,121

(22) Filed: Jan. 10, 2025

Related U.S. Application Data

(63) Continuation of application No. PCT/CN2024/095577, filed on May 27, 2024.

(51) Int. Cl.
*A43B 5/16* (2006.01)
*A63C 1/02* (2006.01)

(52) U.S. Cl.
CPC . *A43B 5/16* (2013.01); *A63C 1/02* (2013.01)

(58) Field of Classification Search
CPC ..... A43B 5/16; A43B 5/1608; A63C 1/02
See application file for complete search history.

(56) References Cited

U.S. PATENT DOCUMENTS 5,836,592 A * 11/1998 Chang ..... A63C 17/06 280/11.26
6,217,039 B1 * 4/2001 Iverson ..... A43B 5/1608 280/11.26
6,450,510 B1 * 9/2002 Liu ..... A63C 17/06 280/11.26
2002/0041073 A1 * 4/2002 Chen ..... A63C 1/26 280/11.26
2010/0156058 A1 * 6/2010 Koyess ..... A43B 5/16 12/142 P
2014/0265175 A1 * 9/2014 Labonte ..... A63C 1/32 280/11.18
2019/0191816 A1 6/2019 Seguin et al.
2020/0316451 A1 * 10/2020 Van Horne ..... A63C 1/26
2023/0389647 A1 * 12/2023 Champagne ..... A43B 23/081

* cited by examiner

*Primary Examiner* — Brian L Swenson
(74) *Attorney, Agent, or Firm* — Nicholas Makridakis

(57) ABSTRACT

Disclosed is a figure skate, which includes a shell case, a toe cap, and an ice skate blade. The shell case and the toe cap are fixedly connected through rivets on both sides. An inner side of a front end at the bottom of the shell case has open butted front sole and front inner groove, an outer side of a back end of the toe cap has open butted inner sole and back outer groove, and rivet connecting holes are formed in the front inner groove and the back outer groove. The back outer groove and the front inner groove are in seamless connection. The front sole has an arc-shaped upper groove surface, and the inner sole has an arc-shaped lower groove surface. The inner sole and the front sole, as well as the lower groove surface and the upper groove surface all are in seamless connection.

2 Claims, 5 Drawing Sheets

FIGURE SKATE

TECHNICAL FIELD

The present disclosure relates to the technical field of ice skates, and in particular, to a figure skate.

BACKGROUND

Figure skating is an elegant sports art movement integrating skating and dancing, which is very popular among people. In this sport, a figure skate is an indispensable device. Although there are many types of existing figure skates with different structures, they are often complicated, which is adverse to production, and appear to be not luxury, which is adverse to high-end art movements and elegant models.

SUMMARY

An objective of the present disclosure is to provide a figure skate that is favorably produced, more high-end and elegant, more beneficial for high-end art movements and elegant models, and simpler and stable in structure, so as to overcome defects mentioned in the background.

To achieve the above objective, the present disclosure uses the following technical solution: a figure skate, which includes a shell case, a toe cap butted with the shell case, and an ice skate blade arranged at the bottoms of the shell case and the toe cap. The shell case and the toe cap are fixedly connected through rivets on both sides, and the ice skate blade is fixedly connected to the bottoms of the shell case and the toe cap through rivets.

As a preferred solution of the present disclosure, an inner side of a front end at the bottom of the shell case has an open butted front sole and an open butted front inner groove, and a rivet connecting hole is formed in the front inner groove. An outer side of a back end of the toe cap has an open butted inner sole and an open butted back outer groove, and a rivet connecting hole is arranged in the back outer groove.

As a preferred solution of the present disclosure, the inner sole and the front sole are in seamless connection up and down and front and back, and the back outer groove and the front inner groove are in seamless connection inside and outside and front and back.

As a preferred solution of the present disclosure, the front sole has an arc-shaped upper groove surface, and the inner sole has an arc-shaped lower groove surface. The lower groove surface and the upper groove surface are in seamless connection up and down and front and back.

As a preferred solution of the present disclosure, the front sole has an arc-shaped boss, and the inner sole has an arc-shaped concave notch. The concave notch and the boss are in seamless connection in a front-back embedding manner.

As a preferred solution of the present disclosure, the top of an inner side of the back outer groove has a backward wedge, and the top of the front inner groove has a backward wedge groove. The wedge and the wedge groove are in seamless connection up and down and front and back.

As a preferred solution of the present disclosure, outer sides of the shell case and the toe cap have a butting line, and the butting line is in a forward "W" shape.

The present disclosure has the following beneficial effects: since the figure skate includes the shell case, the toe cap butted with the shell case, and the ice skate blade arranged at the bottoms of the shell case and the toe cap, the shell case and the toe cap are fixedly connected through the rivets on both sides, and the ice skate blade is fixedly connected to the bottoms of the shell case and the toe cap through the rivets, during production, it is only needed to form the shell case, the toe cap, and the ice skate blade, then connect and assemble them through the rivets, and an edge of a front opening is perforated to thread a shoelace to connect a protective sheet in the shoelace, so that the figure skate is favorably produced; since the shell case and the toe cap are connected and formed by the rivets, and the outer sides of the shell case and the toe cap have the "W"-shaped butting line, so that the body structure is refined, and the figure skate is more delicate and high-end. Therefore, the figure skate is high-end and elegant, which is more beneficial for high-end art movement and elegant models; and due to the use of the abutting structures of the open butted front sole, inner front groove, inner sole, back outer groove, boss, concave notch, wedge, and wedge groove, the abutting connection structure of the shell case and the toe cap are more stable and simpler, which facilitates production.

DETAILED DESCRIPTION

The technical solutions in embodiments of the present disclosure will be described clearly and completely hereinafter with reference to the accompanying drawings in the embodiments of the present disclosure. Apparently, the described embodiments are only a part rather than all of the embodiments of the present disclosure. All other embodiments obtained by those of ordinary skill in the art based on the embodiments of the present disclosure without creative efforts shall fall within the protection scope of the present disclosure.

In order to facilitate an understanding of the present disclosure, the present disclosure will be described more comprehensively below with reference to related accompanying drawings. Several embodiments of the present disclosure are given in the accompanying drawings. However, the present disclosure can be implemented in many different forms, and is not limited to the embodiments described herein. Rather, these embodiments are provided so that the disclosed content of the present disclosure will be more thorough and complete.

It should be noted that when an element is considered to be "fixedly arranged" on another element, the element may be directly on another element or there may be an intermediate element. When an element is considered to be "connected" to another element, the element may be directly connected to another element or there may be an intermediate element at the same time. The terms "vertical", "horizontal", "left", "right", and similar expressions used herein are merely used for a descriptive purpose.

Unless otherwise defined, all technical and scientific terms used herein are the same as meanings of general understandings of those skilled in the art of the present disclosure. The terms used in the specification of the present disclosure herein are only for the purpose of describing specific embodiments, but are not intended to limit the present disclosure. As used herein, the term "and/or" includes any and all combinations of one or more of the associated listed items.

Figure 1:
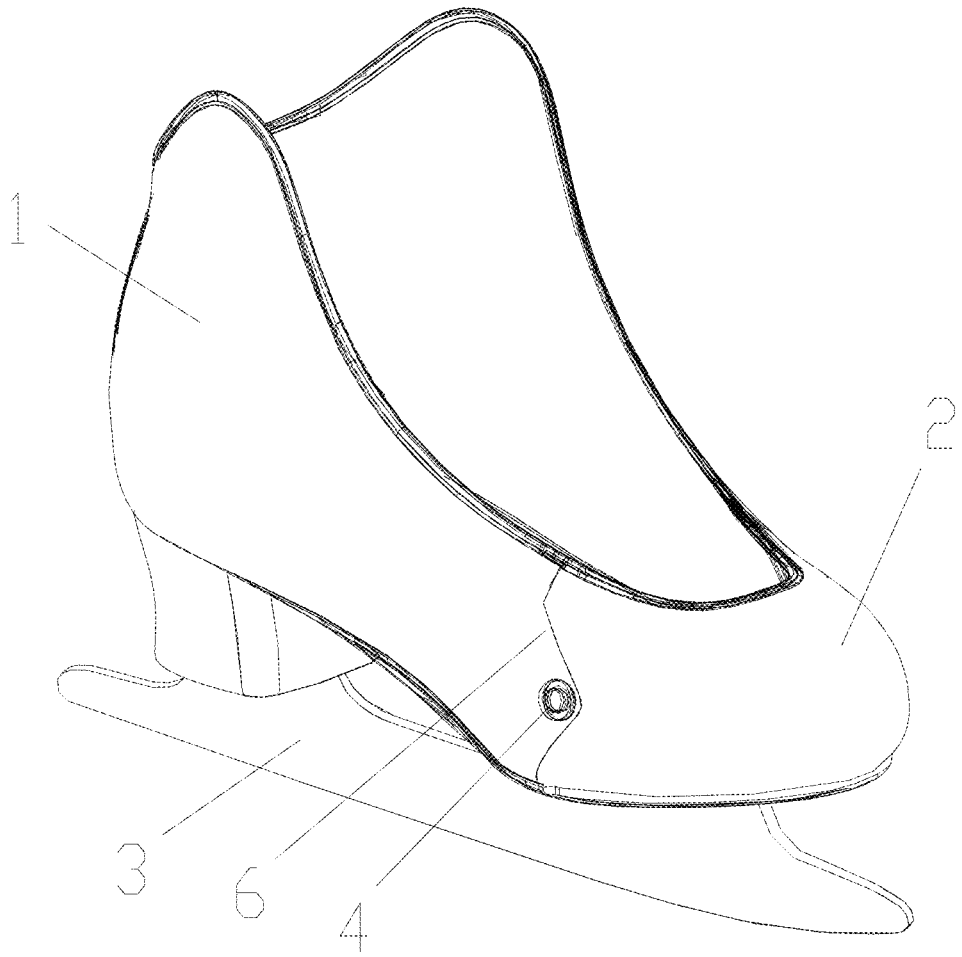
FIG. 1 is a three-dimensional schematic structural diagram of the present disclosure.
Figure 2:
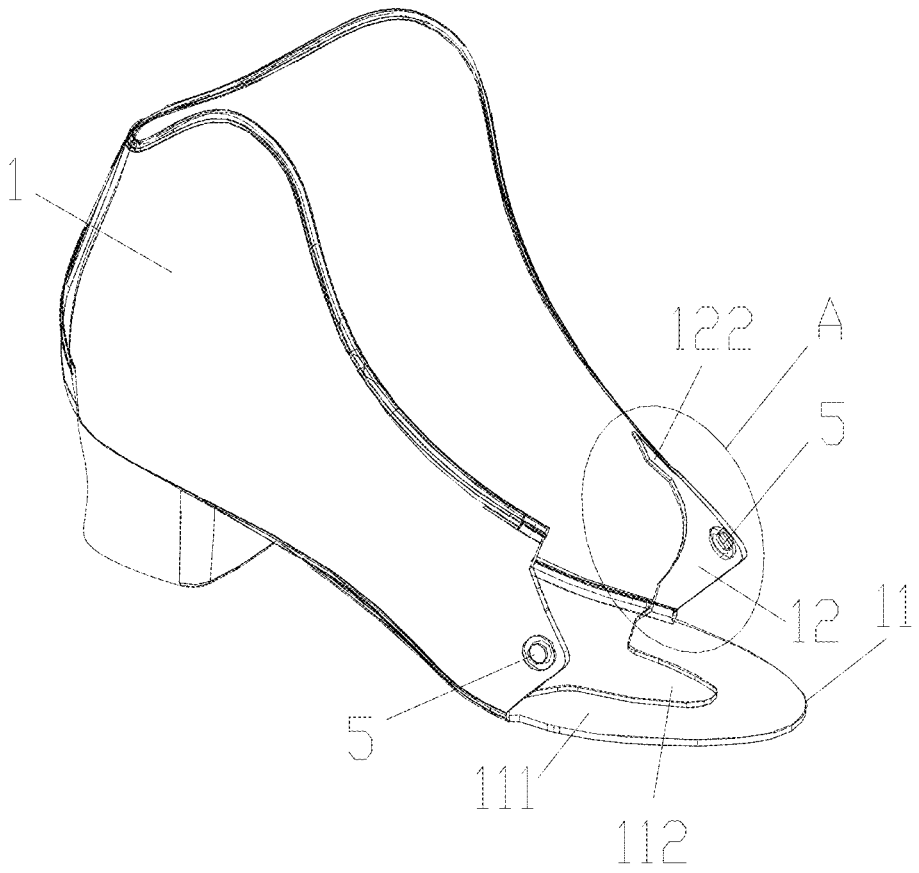
FIG. 2 is a three-dimensional schematic structural diagram of a shell case of the present disclosure.
Figure 3:
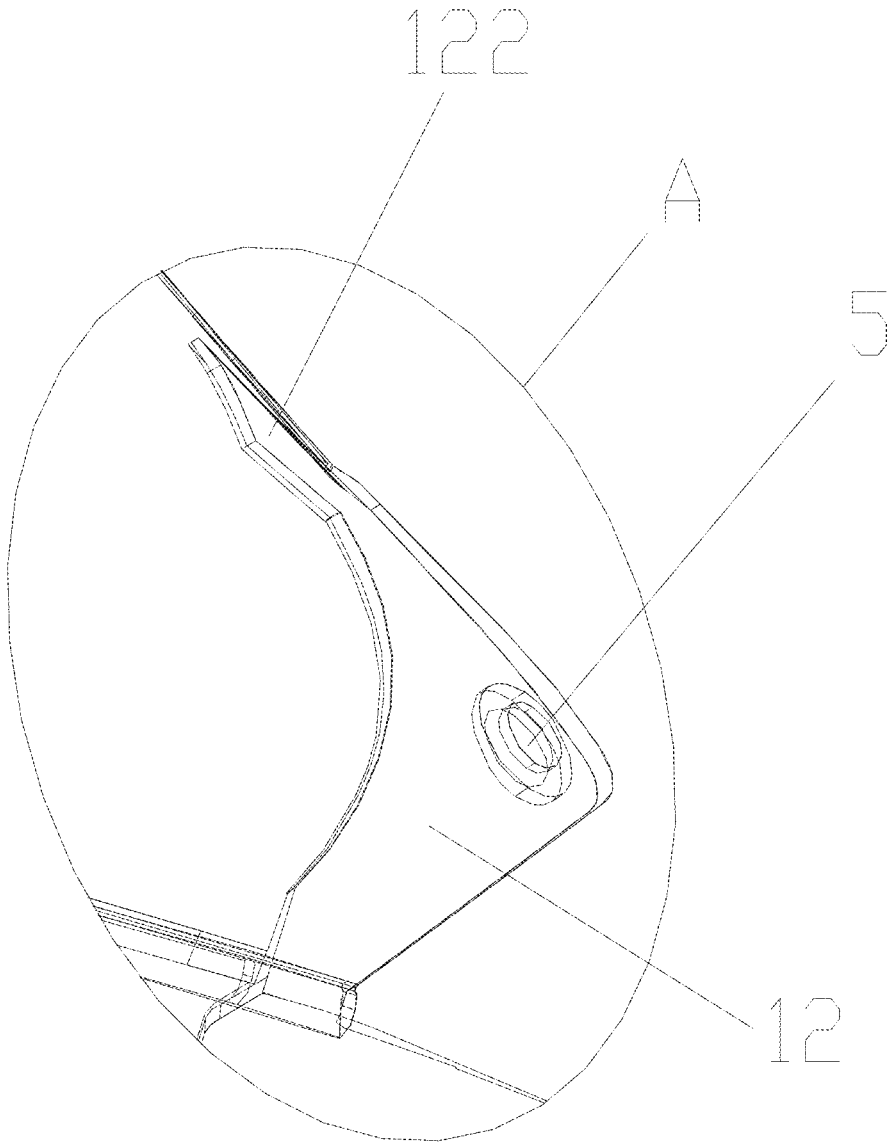
FIG. 3 is an enlarged schematic structural diagram of A in FIG. 2.
Figure 4:
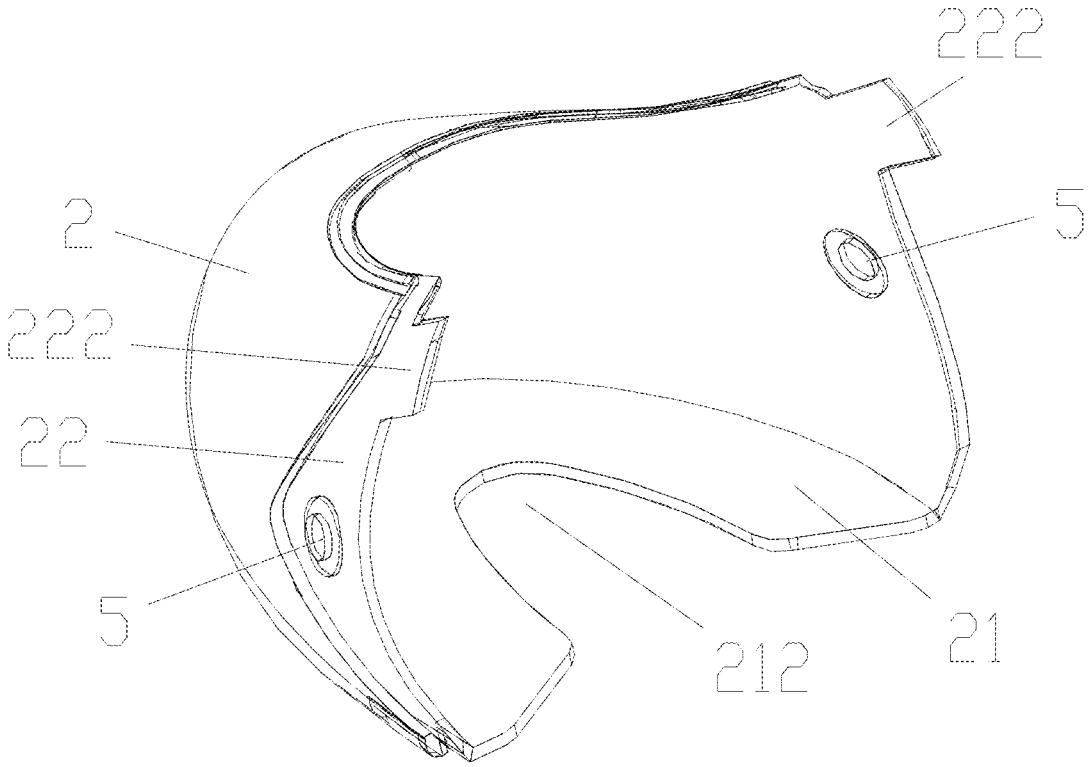
FIG. 4 is a three-dimensional schematic structural diagram of a toe cap of the present disclosure.
Figure 5:
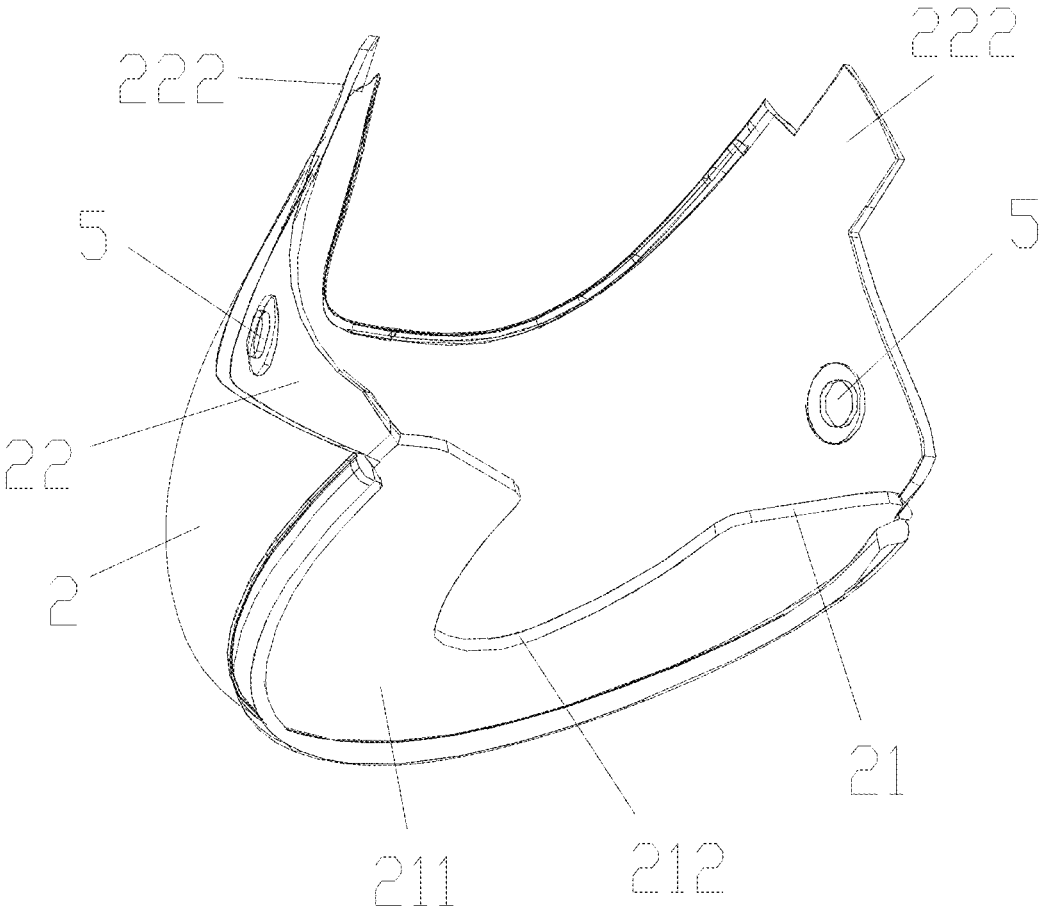
FIG. 5 is a three-dimensional schematic structural diagram of the toe cap of the present disclosure from a bottom viewing angle.

Referring to FIGS. 1-5, the technical solution used by the present disclosure is as follows: a figure skate, which includes a shell case 1, a toe cap 2 butted with the shell case 1, and an ice skate blade 3 arranged at the bottoms of the shell case 1 and the toe cap 2. The shell case 1 and the toe cap 2 are fixedly connected through rivets 4 on both sides, and the ice skate blade 3 is fixedly connected to the bottoms of the shell case 1 and the toe cap 2 through rivets.

A preferred embodiment: referring to FIGS. 2-5, an inner side of a front end at the bottom of the shell case 1 has an open butted front sole 11 and an open butted front inner groove 12, and a rivet connecting hole 5 is formed in the front inner groove 12. An outer side of a back end of the toe cap 2 has an open butted inner sole 21 and an open butted back outer groove 22, and a rivet connecting hole 5 is arranged in the back outer groove 22. The inner sole 21 and the front sole 11 are in seamless connection up and down and front and back, and the back outer groove 22 and the front inner groove 12 are in seamless connection inside and outside and front and back. The front sole 11 has an arc-shaped upper groove surface 111, and the inner sole 21 has an arc-shaped lower groove surface 211. The lower groove surface 211 and the upper groove surface 111 are in seamless connection up and down and front and back. The front sole 11 has an arc-shaped boss 112, and the inner sole 21 has an arc-shaped concave notch 212. The concave notch 212 and the boss 112 are in seamless connection in a front-back embedding manner. The top of an inner side of the back outer groove 22 has a backward wedge 222, and the top of the front inner groove 12 has a backward wedge groove 122. The wedge 222 and the wedge groove 122 are in seamless connection up and down and front and back. Outer sides of the shell case 1 and the toe cap 2 have a butting line 6, and the butting line 6 is in a forward "W" shape.

After the figure skate is butted and assembled, it is only needed to perforate an edge at openings of the shell case and the toe cap to thread a shoelace and connect a protective sheet in the shoelace. The figure skate is delicate and exquisite, which contributes to promoting figure skating.

The above shows and describes the basic principles, main features, and advantages of the present disclosure. Those skilled in the art should understand that the present disclosure is not limited by the above-mentioned embodiments. The above-mentioned embodiments and description merely describe the principle of the present disclosure. There will be various variations and improvements of the present disclosure without departing from the spirit and scope of the present disclosure, and these variations and improvements shall fall into the claimed scope of the present disclosure. The scope claimed by the present disclosure is defined by the appended claims and their equivalents.

What is claimed is:

1. A figure skate, comprising a shell case (1), a toe cap (2) butted with the shell case (1), and an ice skate blade (3) arranged at the bottoms of the shell case (1) and the toe cap (2), wherein the shell case (1) and the toe cap (2) are fixedly connected through rivets (4) on both sides, and the ice skate blade (3) is fixedly connected to the bottoms of the shell case (1) and the toe cap (2) through rivets;

wherein an inner side of a front end at the bottom of the shell case (1) has an open butted front sole (11) and an open butted front inner groove (12), a rivet connecting hole (5) is formed in the front inner groove (12), an outer side of a back end of the toe cap (2) has an open butted inner sole (21) and an open butted back outer groove (22), and a rivet connecting hole (5) is arranged in the back outer groove (22);

wherein the inner sole (21) and the front sole (11) are in seamless connection up and down and front and back, and the back outer groove (22) and the front inner groove (12) are in seamless connection inside and outside and front and back;

wherein the front sole (11) has an arc-shaped upper groove surface (111), the inner sole (21) has an arc-shaped lower groove surface (211), and the lower groove surface (211) and the upper groove surface (111) are in seamless connection up and down and front and back;

wherein the front sole (11) has an arc-shaped boss (112), the inner sole (21) has an arc-shaped concave notch (212), and the concave notch (212) and the boss (112) are in seamless connection in a front-back embedding manner;

wherein the top of an inner side of the back outer groove (22) has a backward wedge (222), the top of the front inner groove (12) has a backward wedge groove (122), and the wedge (222) and the wedge groove (122) are in seamless connection up and down and front and back.

2. The figure skate according to claim 1, wherein outer sides of the shell case (1) and the toe cap (2) have a butting line (6), and the butting line (6) is in a forward "W" shape.

* * * * *